US005398340A

United States Patent [19]

Kibbee

[11] Patent Number: 5,398,340

[45] Date of Patent: Mar. 21, 1995

[54] BULLET RESISTANT VEST AND VEST COVER

[76] Inventor: Rick E. Kibbee, 795 Ludlow Ave., Cincinnati, Ohio 45220

[21] Appl. No.: 58,985

[22] Filed: May 5, 1993

[51] Int. Cl.[6] ..... F41H 1/02

[52] U.S. Cl. ..... 2/2.5; 2/102; 2/117; 2/919

[58] Field of Search ..... 2/78.4, 112, 2, 2.5, 2/908, 92, 44, 120, 408, 403, 406, 229, 117, 115, 919, 920, 102

[56] References Cited

U.S. PATENT DOCUMENTS

| | | | |
|---|---|---|---|
| 1,246,274 | 11/1917 | Jelalian . | |
| 1,998,085 | 4/1935 | Jones | 2/78.4 X |
| 2,671,222 | 3/1954 | Hochberg | 2/229 X |
| 2,790,973 | 3/1954 | Lewis et al. . | |
| 3,292,181 | 3/1964 | Kennedy et al. . | |
| 3,696,439 | 10/1972 | Durham . | |
| 3,771,171 | 11/1973 | Mitchell . | |
| 4,074,364 | 2/1978 | Lucero | 2/117 |
| 4,597,109 | 7/1986 | Hironaga | 2/117 X |
| 4,597,110 | 7/1986 | Smith, Sr. et al. | 2/406 X |
| 4,660,223 | 4/1987 | Fritch . | |
| 4,675,918 | 6/1987 | O'Brien | 2/919 X |
| 4,697,285 | 10/1987 | Sylvester | 2/2 X |
| 4,870,706 | 10/1989 | Ketcham et al. | 2/2 |
| 4,884,295 | 12/1989 | Cox . | |
| 4,989,266 | 2/1991 | Borgese et al. . | |
| 5,033,121 | 7/1991 | Larsen | 2/115 X |
| 5,060,314 | 10/1991 | Lewis . | |
| 5,072,453 | 12/1991 | Widder . | |
| 5,073,985 | 12/1991 | Stone et al. . | |
| 5,127,105 | 7/1992 | Sacks . | |
| 5,187,817 | 2/1993 | Zolner | 2/236 X |

FOREIGN PATENT DOCUMENTS

| | | | |
|---|---|---|---|
| 2249941 | 5/1992 | United Kingdom | 2/403 |

OTHER PUBLICATIONS

Brochure entitled "Point Blank Body Armor" dated Jan. 1991.

*Primary Examiner*—Clifford D. Crowder
*Assistant Examiner*—Paul C. Lewis
*Attorney, Agent, or Firm*—Wood, Herron & Evans

[57] ABSTRACT

A bullet resistent vest is provided with a shell that is further provided with a lower garment portion to elastically retain the front center and back center of the shell in position at the front and back centers, respectively, of the waistline of the wearer of the vest. An elastic waistband of the lower garment connects the front and back parts of the vest shell together in a first path around the wearer's waist and a crotch section of the lower garment connects the parts together in a second path between the wearer's legs. The lower garment disconnects in two areas: one preferably from the shell at the front center of the waistband, another either from the shell at the back center of the waistband or to interrupt the continuous waistband itself, preferably on each of its sides.

14 Claims, 3 Drawing Sheets

BULLET RESISTANT VEST AND VEST COVER

The present invention-relates to anti-ballistic clothing and primarily to protective clothing referred to as the bullet resistant or bullet proof vest. More particularly, the present invention relates to fabric covers or shells that form the bullet resistant garment and carry panels of impact resistant material for vests to be worn particularly by law enforcement personnel.

BACKGROUND OF THE INVENTION

Bullet resistant vests are standard equipment for the members of most state and local police departments. These vests are made of a fabric shell, usually of a woven material, containing compartments in which are carried panels of impact absorbing anti ballistic material such as that known Kevlar®, which is a registered trademark of E. I. dupont, Inc. Other such materials are known as Spectra®, a registered trademark of Allied Signal, Inc. and Twaron®, a registered trademark of Akzo, Inc. The vests are designed so that the torso of the wearer is surrounded, at least from the neck to the waist, with a layer of the protective panels.

Routine police usage of these vests subjects the police officer to considerable inconvenience and discomfort. This usage requires the police officer to wear the vest throughout the entire workday, usually beneath the shirt of the standard police uniform. The vests are stiff and constantly shift from their desired position, requiring constant readjustment by the police officers wearing them.

In the line of ordinary duty, the police officer is highly active: walking, reaching, bending, twisting, and stretching while patrolling, entering and leaving vehicles, dealing with suspects and other members of the public in rendering assistance, dealing with disturbances, making arrests and other routine activities. In the course of such duty, vest panels that are only moderately flexible but inelastic, and that will bend somewhat but will not stretch, do not conform to the shape of the police officer's body as it moves over the course of the day.

In the design of the vests, various straps, ties and tails have been incorporated to retain the generally protective arrangement of the panels and to fit the vest assembly to the body of the wearer. These have not been effective to hold the vest in place throughout the police officer's work day. The common experience of the police officer wearing these vests is that they tend to move upward on the body around the neck of the wearer, exposing much of the police officer's midsection above the waist. The vests also twist in relation to the police officer's body and outer clothing. This limits the protection that the vest provides and requires the wearer to take the time at frequent intervals throughout the day for readjustment of the vest and the clothing.

More elaborate strapping attachments have been proposed for such protective garments when used in military applications, particularly by those confined to vehicles such as combat aircraft and land vehicles, but these designs have not been suitable for the day to day use by a police officer.

Thus, there is a need for an anchoring system for ballistic resistant vests worn by police officers in every day duty that retains proper protective positions of the impact resistant panels, accommodating the mobility of wearer, and preserves the comfort and neatness of the vest throughout the day.

SUMMARY OF THE INVENTION

A primary objective of the present invention is to provide a flexible anchoring system for a bullet resistant vest that will preserve the position of the protective panels of the vest and the comfort, neatness, safety and mobility of the police officer wearing the vest throughout a day of duty.

It is a particular objective of the present invention to provide a bullet resistant vest having a cover or shell that makes it easy for the police officer to put on and adjust to the proper wearing position and that will remain in position beneath the police officer's uniform as the police officer performs body movements throughout the normal day of duty.

According to the principles of the present invention, a ballistic or bullet resistant vest is provided with a system for holding impact resistant panels in positions surrounding the upper torso of a wearer, at least partially suspending the vest from the wearer's shoulders. The system holds the panels in position by securing the vest in the vicinity of the waist of the wearer in relation to the wearer's lower torso when fitted or adjusted to the wearer when in a normal posture, to continually urge the protective panels of the vest into vertical and circumferential registration with respect to wearer's waist.

To this end, in the preferred embodiment of the invention, a shell includes a conventional upper shell portion to hold the protective panels and register the vest with the shoulders and upper body of the wearer, which is provided with a flexible anchoring system that includes a lower garment portion of a generally elastic material securable to the upper portion to elastically hold the vest in position with respect to the waist of the wearer, permitting the vest to move away from the waist with the body movements of the wearer, but to return to the desired position with respect to the wearer's waist.

The lower portion includes a waistband that extends around the waist and a crotch section that extends between the legs of the wearer, conforming to the lower torso of the wearer in the manner of a conventional undergarment. The lower garment portion of the vest is connected at the center of the front and back of the waistband to the panel portion of the vest, at a level generally designed to align with the waist of the wearer. The lower portion is at least partially detachable, preferably from the upper garment portion at the waistband, and preferably in the center of the front thereof, and in at least one embodiment also at the center of the back.

In the preferred embodiments of the invention, the lower garment has four potential areas of detachable connection to facilitate the putting on and taking off of the vest and to simplify the adjustment of the vest on the wearer's body. In each of the preferred embodiments illustrated and described below, detachable connections in at least two of three of these areas are provided to permit easy and convenient use by the wearer and minimize the time and effort in putting on and adjusting the vest. At the areas of detachable connection, pressure responsive connection material is preferably employed, as for example as hook and loop fastener material or tape such as that available under the trademark Velcro®.

The three preferred areas of connection include a first area that includes a connection point between the front center of the waistband of the lower garment to a point at the front center waist level the vest cover. In both of the illustrated embodiments, this area is made detachable. A second area of connection includes a connection point between the back center of the waistband of the lower garment to a point at the back center waist level the vest cover. In a first illustrated embodiment, this attachment area is a permanent connection. In a second illustrated embodiment, this connection area is a detachable connection. The third area of connection includes points on both sides of the waistband of the lower garment in the vicinity of the hips of the wearer.

In the first embodiment in which the back connection is permanent, the side connection points are detachable, permitting the wearer to install and remove the vest by disconnecting the front connection and side connections, leaving the lower garment attached to the panel carrying shell portion at the back. In the second embodiment in which the back connection is detachable, the side connection points are permanent, thus permitting a continuous waistband, and a fully detachable lower garment portion that can be put on and removed by the wearer in the same manner as a conventional undergarment.

In another embodiment of the invention, a fourth area of connection located in the crotch portion between the legs of the wearer is made a detachable connection point. In this embodiment, the second area of connection that is made detachable is that which includes the side connection points.

In its various embodiments, the lower garment elastically secures the upper vest portion of the shell at the front and back centers of the waistline of the wearer, with a continuous elastic waistband that encircles the waist of the wearer in a first path of elastic attachment between the front and back parts of the shell, and with a continuous crotch portion that connects the these points in a second path between the legs of the wearer. The lower garment provides two detachable connections, one for interrupting each of the paths, so that the vest can be put on and removed from the wearer. Preferably, the waistband is several inches wide, and preferably also the crotch portion is V-shaped, connecting to the waistband at spaced points on the front and back, forming a triangular shape to better maintain the centers of the waistband in place at the front and back center of the wearer's waist.

With the present invention, the wearer puts on the vest and adjusts the panels and upper shell portion to the desired position. Then the anchoring system is set in place by positioning the lower garment about the lower torso of the wearer, with the elastic waistband surrounding the wearer's waist, and with the crotch portion extending between the wearer's legs. In doing so, the two detachable connections are attached so that the waistband surrounds the wearer's waist, with the waist level of the shell connected to the waistband at the center, front and back.

So designed and worn, the centers of the back and front of the upper portion of the vest shell, which usually coincide with the bottom edges of the impact resistant panels, are held in position at the front and back centers of the wearer's waist. As the non-elastic panels move with respect to the wearer's waist with the upper torso and shoulder movement of the wearer, the front and back centers of the waist level of the upper portion of the vest remain attached to the respective front and back centers of the waistband of the elastic lower garment, and are constantly pulled back to their initial positions at the front and back of the wearer's waist, as the lower garment stretches but remains in conformity with the lower torso of the wearer.

As configured, the lower garment portion of the shell connects the front and back parts of the upper vest portion together at the front and back waist level, both with the waistband around the waist of the wearer and with the crotch section between the legs of the wearer. By being disconnectably configured in at least two areas, both the waist and crotch connections between these front and back parts can be broken for easy putting on and removal of the vest.

These and other objectives and advantages of the present invention will be apparent from the following detailed description of the drawings in which:

In the detailed description of the Figures below, alternative versions of elements or assemblies are designated by a number followed by a letter to refer to the particular embodiment or alternative. References in the specification to all of the alternatives are generically referred to by the common number only.

DETAILED DESCRIPTION OF THE DRAWINGS

Figure 1:
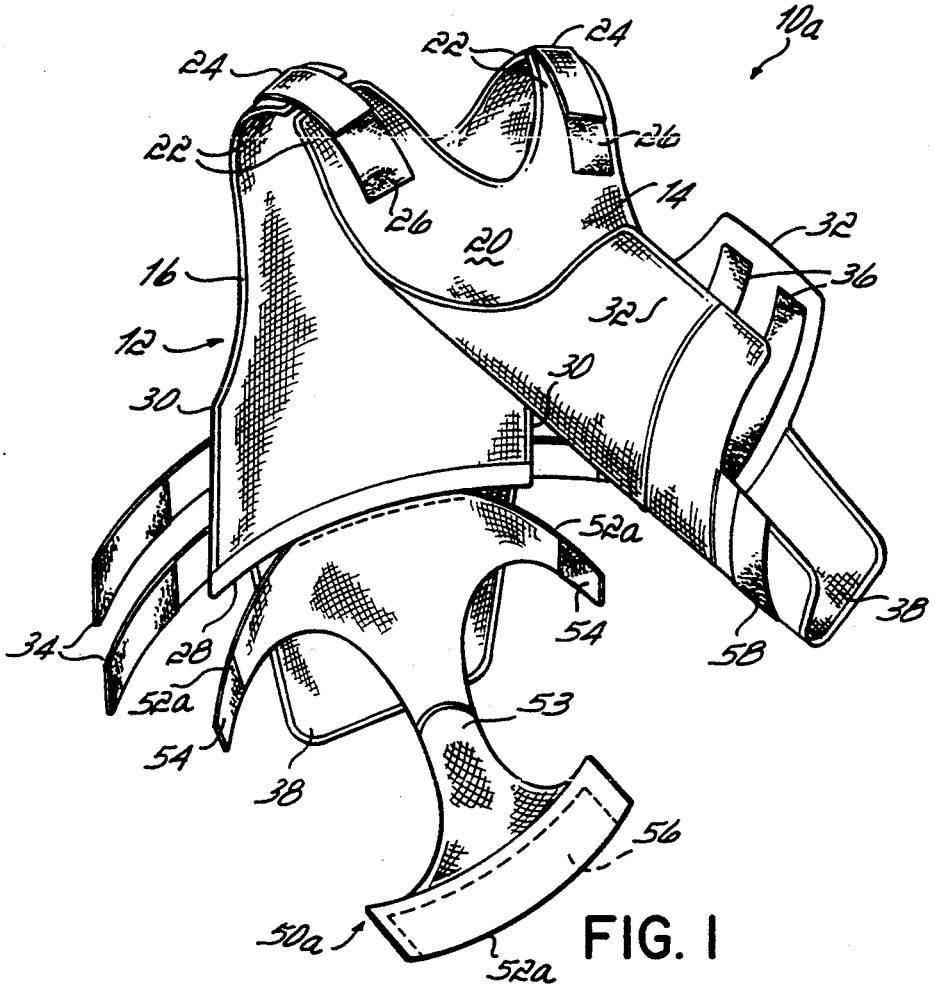
FIG. 1 is a perspective view of a bullet resistant vest and a vest shell assembly according to the principles of the present invention, illustrating one embodiment of the vest in an unfastened condition.
Figure 2:
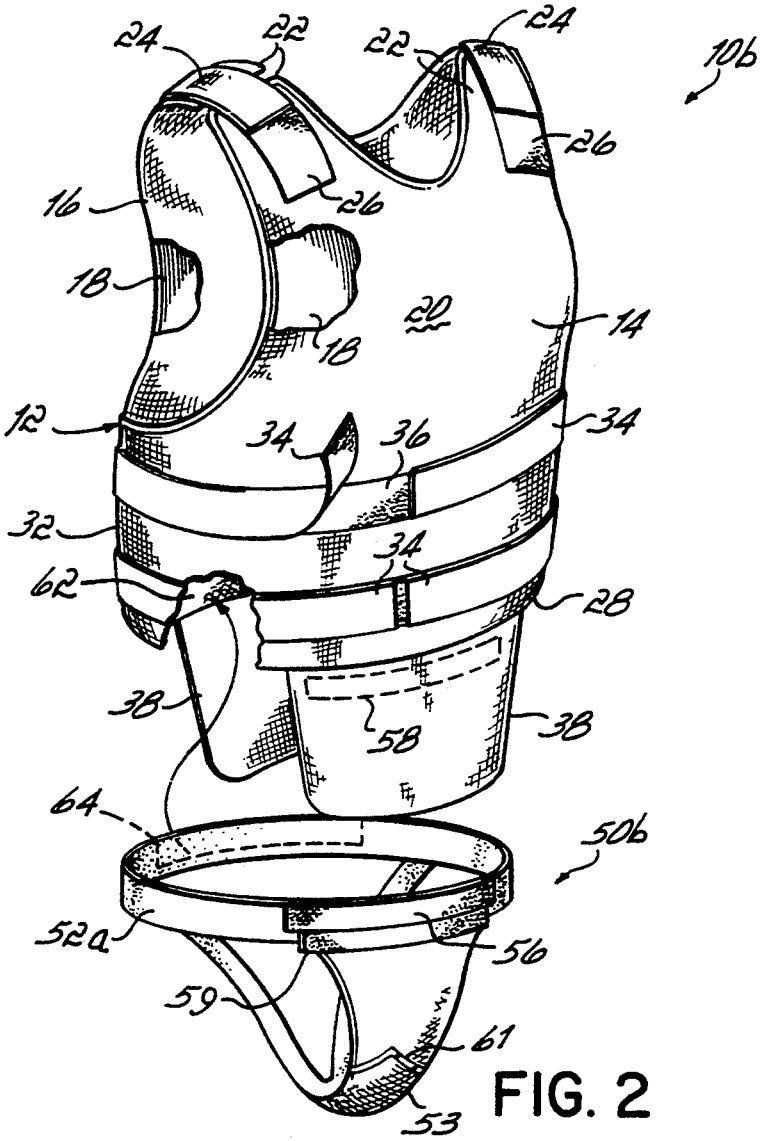
FIG. 2 is a perspective view similar to FIG. 1 illustrating a second embodiment of the invention in the arrangement it would assume when in fastened condition when being worn by a user as illustrated in FIG. 1A.

The illustrated embodiments of the bullet resistant vest assembly 10, depicted respectively as vest assemblies 10*a* in the embodiment of FIG. 1 and 10*b* of FIG. 2, each preferably include an upper or vest portion 12 and a lower garment portion 50. The upper portion 12 is in the form of a conventional bullet resistant vest of the type in widespread use today by state, local and certain federal law enforcement agents. The upper portion 12 is made up of separate front and back parts 14 and 16, respectively, that are detachably and adjustably connectable together to form the conventional protective portion 12 that generally fits the upper torso of the user.

Referring to both FIGS. 1 and 2, the vest 12 is made up of protective panels 18 (FIG. 2) of impact resistant material, such as the products known as Kevlar®, Spectra® or Twaron®. The panels 18 include one or more sections in each of the front and back parts 14 and 16 of the vest 12. These panels 18 are contained in a conventional cover or shell 20, forming the upper portion of the protective garment 10 of the preferred embodiments of the present invention. The impact resistant material of which the panels 18 are formed is moderately flexible, permitting the panels to bend, as illustrated in FIG. 1. The material, however, does not stretch, and, accordingly, once fastened in position on the wearer, as illustrated in FIG. 2, presents a somewhat rigid enclosure around the upper torso of the wearer.

Referring to FIG. 1, the front and back parts 14 and 16 of the conventional vest 12 each have a pair of shoulder flaps 22, including a right flap and a left flap, each respectively connectable together by hook and loop tape shoulder strap assemblies that include straps 24 and pads 26. The straps 24 are usually the hook portion of the tape and attached to the shoulder flaps 22 of the back part 16 of the vest 12, and attachable are to pads 26 sewn to the flaps 22 of the front part 14 of the shell 20 of the vest 12, which contain the loop portion of the tape.

Figure 1A:
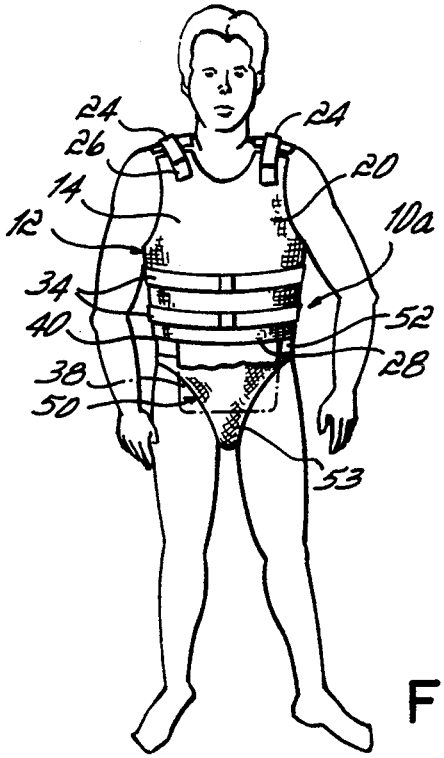
FIG. 1A is a perspective view of a the vest of FIG. 1 on a wearer.

Normally, the user adjusts the straps 24 on the pads 26 so that the bottom edge of the protective panels 18 aligns with the waist of the user at a waist level 28, as illustrated in FIG. 1A, so that the bottom edge of the panels 18 will touch the upper edge of the police officer's belt. Once adjusted, the user will remove and put on the vest overhead, with the shoulder straps 24 attached.

The conventional vest 12 has a pair of short side flaps 30 on the back part 16 and a pair of longer side flaps 32 on the front part 14 of the vest 12. As with the shoulder flaps 22, the side flaps 30 and 32 connect together with hook and loop tape, with straps 34, which usually carry the hook portion of the tape, sewn to the back flaps 32 of the back part 16, and pads 36, made of the loop portion of the tape, sewn to the flaps 32 of the front part 14 on the shell 20. When the vest 12 has been positioned on the shoulders of the wearer, with the waist level 28 properly aligned with the waist of the wearer, the straps 34 are adjusted such the rear edge of the panels 18 of the front part 14 of the vest 12 abut the forward edge of the panels 18 of the back part 16 along the wearer's sides. Where the vest 12 is the proper size for the user, the panels 18 will encircle the torso of the wearer in a moderate to snug fit, as illustrated in FIGS. 1A and 2. The front and back parts 14 and 16, respectively, of the vest 12 are respectively provided with front and back tails 38 that are tucked into the pants of the user when the vest 12 is worn, to attempt to keep the vest 12 in position.

Figures 4, 4A, 4B, 4C:
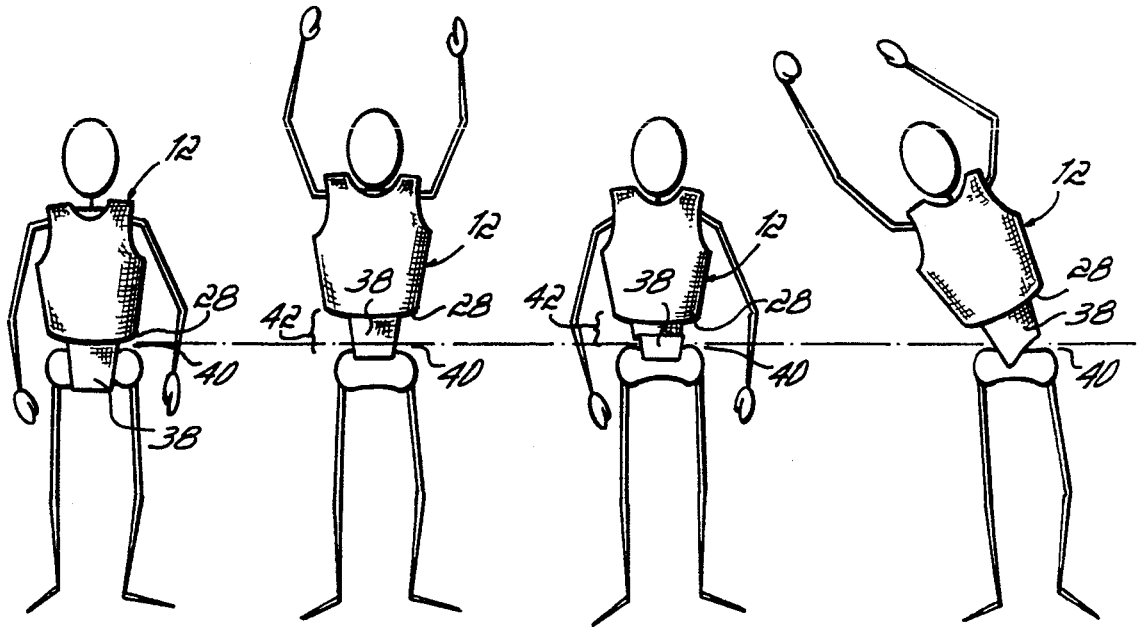
FIG. 4–4C are a series of diagrammatic illustrations showing the problems presented by vests of the prior art in retaining their position on the user.

FIG. 4 illustrates a conventional vest forming the upper portion 12 and positioned and adjusted on a user, with the waist level 28 of the vest 12 at the waist 40 of the user. As shown in FIG. 4A, when the user reaches upward, the user's upper torso stretches, and the user's shoulders lift the unstretchable panels 18 such that the waist level 28 of the vest 12 is lifted above the waist 40 of the user, exposing the midsection of the user, as illustrated at 42. This causes the tails 38 to be pulled up from behind the user's belt. In this way, the vest 12 rides up against the user's body and uniform such that, when the arms are lowered, the tails 38 remain pulled above the belt to a degree and the waist level 28 of the vest 12 settles above the waist 40 of the user, as illustrated in FIG. 4B, leaving gap 42 at the midsection of the user.

Furthermore, when the user leans or stretches to one side, as illustrated in FIG. 4C, the vest 12 rides up more on one side than the other, pulling the tails 38 to one side, so that the vest may become asymmetrically moved out of position when the user returns to the posture illustrated in FIG. 4B. In some military applications, such as for pilots of military aircraft, where the wearer of a vest remains more or less in a stationary position, canvas or nylon straps have been used connecting the shell 20 of the vest 12 between the legs of the wearer. This, however, interferes with the mobility of the user, while only partially solving the problems illustrated in FIGS. 4–4C, and particularly does not prevent misalignment of the vest as illustrated in FIGS. 4C and 4B. As such, the use of straps that are inelastic, or straps that connect only to the shell 20, are unsuitable for the daily use of active police officers.

Referring again to FIG. 1, in accordance with one embodiment of the present invention, a lower garment portion 50 (i.e., 50*a* in FIG. 1 or 50*b* in FIG. 2) is provided, having a waistband 52 that is formed of elastic material, such as rubber elastic fiber. In the embodiment 10*a*, a lower garment in the form 50*a* has a waistband that is in the form of waistband 52*a*, split at the sides. The garment 50*a* also has a crotch portion 53 that is formed of elastic material, preferably a knitted cloth material, which derives its elastic properties from the knit stitching employed.

In this embodiment 10*a* of FIG. 1, the center of the waistband 52*a* of the lower garment portion 50*a* of the vest assembly 10*a* is permanently sewn at the waist level 28 to the shell 20 on the back part 16 of the vest 12. At the sides, the waistband 52*a* is provided with hook and loop connection tape, including straps 54 on the back section thereof carrying the hooked portion 55 of the tape, and a pad 56 sewn to the front section thereof, carrying the loop portion of the connection tape.

Sewn to the inside the front tail 38 is one portion of a hoop and loop tape connector 58, which attaches to the opposite portion 60 of the tape, which is preferably the center of the pad 56, sewn to the front center of the waistband 52*a*, to attach the front center of the front part 14 of the vest 12 at the waist level 28 with the front center of the waistband 52*a* of the lower garment 50.

In the embodiment of FIG. 1, alternatives may be formed by modifying the lower garment portion 50*a* so that the waistband 52*a* is permanently sewn at the waist level 28 of the front part 14 at the tail 38, where the pad 56 connects to the tape 58 in the form illustrated in FIG. 1, and with a detachable connection area in the crotch section 53, between the legs of the wearer. Further, the connections such as those of the waistband straps 54 and the crotch section 53 may connect directly or to the waist level section 28 of the upper vest portion 12, by connecting to each other and then one of them connecting to the vest portion, as in the illustrated embodiments.

To put on the vest of the embodiment 10*a*, the wearer fastens and adjusts the conventional vest 12 as described above, then attaches the side straps 54 to the pad 56 of the waistband 52*a* so that the lower garment 50*a* is positioned comfortably on the user's lower torso with the waistband 52*a* about the user's waist, at the waist level 40. Since the upper vest 12 has been adjusted at the shoulders to the size of the wearer, the waist level 28 at the back will be at the wearer's waistline 40. Then, the wearer attaches tape portion 58 at the front part 14 of the shell 20 to the center of the tape portion 56 on the front of the waistband 52*a*, thereby bringing the waist level 28 in line with the waistband 52*a* at the front.

Figures 5, 5A, 5B:
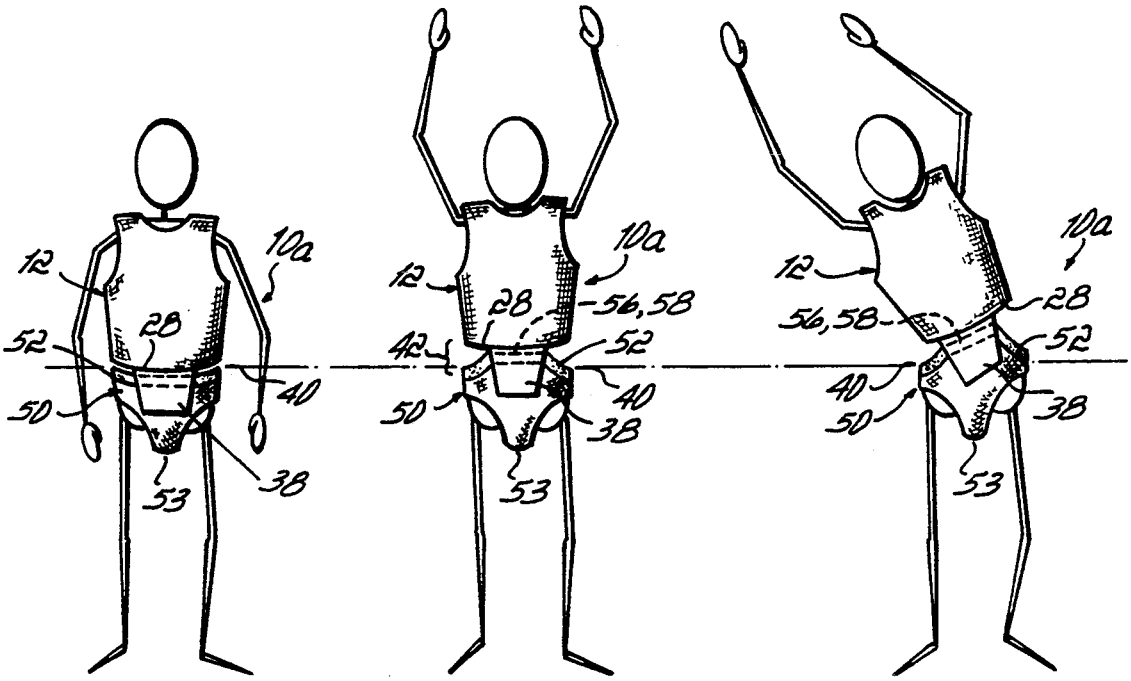
FIG. 5–5B are a series of diagrammatic illustrations showing that the problems illustrated in FIGS. 4–40 are overcome by vests according to the principles of the present invention.

As can be seen from FIGS. 5–5B, which correspond to the motions of the user illustrated in FIGS. 4–40, the problems that arise with the conventional vest do not arise with the present invention. FIG. 5 appears the same as FIG. 4, except that the vest is secured to an elastic waistband 52 at the centers of the front and back at the waist 40 of the wearer. Thus, when the user's hands are raised, as in FIG. 4A, the vest portion 12, with its unstretchable panels 18, raises away from the waistline 40 of the wearer, also leaving the same space 42, as illustrated in FIG. 4A. In FIG. 5A, however, the elastic waistband 52 stretches upward, and the crotch portion 53 stretches linearly, to follow the waist level 28 to which it is attached.

When the arms of the user are then lowered, however, unlike the vest of the prior art illustrated in FIG. 4B, the center of the vest at the waist level 28 pulled back down to the waistline 40 of the wearer, pulling the entire vest portion 12 downward such that the bottoms of the panels 18 again rest at the level of the waistline 40 of the user, as illustrated in FIG. 5B. Except that the tails may be pulled up somewhat at the belt of the wearer, the vest 10*a* is in approximately the same position as in FIG. 5.

When the wearer assumes a position of stretching to the side as illustrated in FIG. 5C, the waistband 52 similarly extends upward, but tends to pull the waist level 28 of the vest also toward the center, because the waistband 52 is fitted about the waistline 40 of the wearer. Thus, when the user relaxes as illustrated in FIG. 5D, the elastic lower garment 50 pulls the vest 12 again to the center and at the waist line 40 of the user, to assume a position similar again to that of FIG. 5B.

Figure 3:
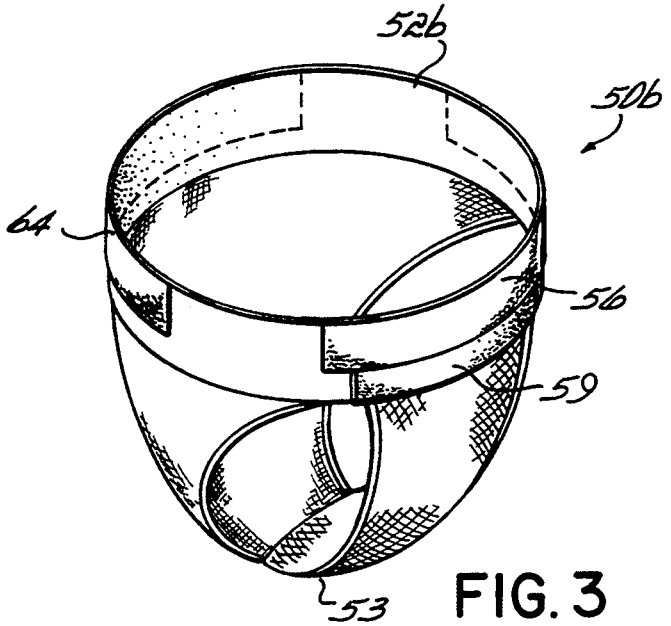
FIG. 3 is a perspective view of an alternative form of the lower garment portion of the embodiment of FIG. 2.

The embodiment of the invention illustrated in FIG. 2, when assembled on the wearer, functions similar to the embodiment of FIG. 1, in the manner illustrated in the series of FIGS. 6–6D. However, it is put on and connected differently. As illustrated in FIG. 2, the lower garment 50 is in the form of a conventional undergarment 50*b*, that may take the form of an athletic supporter, as illustrated in FIG. 2, or briefs designed for either male or female anatomy, the female version of which is illustrated in FIG. 3. To facilitate the use of the bathroom by the wearer without total disassembly of the lower garment 50 from the upper shell 12, either or both of the versions 50*a* or 50*b* of the lower garment 50 may be provided with a crotch portion 53 that is detachable, for example, along the front of the waistband 52, by provision of a hook and loop connector 59. Further, a fly 61 may also be provided for the male version, of the embodiments of either FIG. 2 or FIG. 3.

The lower garment 50*b* is provided with a continuous waistband 52*b*. At the front, it is provided with a pad of one portion 56 of hook and loop tape, preferably the loop portion. With the lower garment 50, there are three attachment locations, two of which are detachable. As was described with the embodiment of FIG. 1, the center back of the waistband 52*a* was permanently attached to the waist level 28 at the center of the back part 16 of the vest 12. The front center of the waistband 52*a* detachably connected to the center of the waist level 28 of the front part of the vest 12, while the sides of the waistband 52*a* constitutes a third connection area that reconnected the split waistband 52*a* at the sides.

In the embodiment of FIG. 2, the continuous waistband 52*b* may be regarded as permanently connected at the sides, with the other two potential connection areas, at the center front and center back of the waistband 52*b*, detachable connectable to the waist level 28 at the front and back parts 14 and 16, respectively, of the vest 12. Thus, instead of hook and loop tape at the sides of the waistband 52*b*, and instead of the waistband 52*b* being sewn to the vest back part at the waist level 28, hook and loop connector tape is provided at the center of the waistband 52*b* at the back, preferably the loop portion 62 thereof, with the opposite portion 64 of the hook and loop tape sewn to the back part 16 of the vest 12 at the waist level 28.

To put on the vest assembly 10*b*, the user steps into the lower garment 50*b*, thus positioning the waistband 52*b* at the users waist 40. Then, the upper vest portion 12 is put on over the head of the user and the waist level 28 set to the waistline 40 of the user. If the waist level 28 and waistline 40 do not line up, the shoulder straps 28 are adjusted. Then the side straps 34 are adjusted and connected as explained above.

When the top vest portion 12 and the lower garment portion 50*b* of the vest assembly 10*b* are put on and positioned, the front and backs of both are connected together at their centers. Preferably, the back hook and loop tape portions 64 and 62 are joined together, and then the front hook and loop portions 58 and 60 are joined together, both aligning the waist level 28 of the vest portion vertically with the waistline 40 of the user at the front and back centers.

The vest 10 and cover therefore of the present invention solves a problem that police officers have experienced who regularly must wear a bullet resistant vest in the line of duty. Such vests are currently supplied by a handful of manufacturers. All include Kevlar® or similar type panels carried in compartments of a fabric cover.

When worn, the vest, which is placed over the head of the wearer and suspended by the shoulder straps that are adjustable with Velcro® that connects front and rear parts over the shoulders and at the sides so that the Kevlar® panels surround the torso of the wearer between the waist and the arms and extend to near the shoulders on the chest and back. The vest forms a body encircling tube that is somewhat flexible but is of a non-elastic fixed circumference. Similarly, the bullet resistant panel sections are not elastic in the vertical direction between the waist and the shoulders of the wearer.

Prior to the present invention, no means have been provided on the vests to attach the vest at the bottom or to otherwise secure the vest to the wearer's body, and to align the waist level at the front and back of the vest, both laterally and vertically, at the wearer's waist. Only the shoulder straps and the fastening tape that overlies the panel compartments at the sides hold the panels together.

When a vest of the present invention is worn by police officer, difficulty experienced in keeping the vest in place is overcome. Over the course of a day on duty, the tendency of the vest to constantly ride up away from the wearer's waist and toward the neck of the wearer is corrected by the elastic lower garment, and the unique way it is connected to the vest, returning the vest to its proper position at which not only is the discomfort, inconvenience and a messy appearance of the prior art avoided, but the protective panels are maintained in the positions on the body of the police officer where the protective effects are most desired. Since these vests are worn under the police officer's uniform, and usually under the shirt, constant restraightening of the vests, which is not always possible with the prior art, and is almost always inconvenient requiring at least partial disrobing, are unnecessary.

Only certain embodiments of the invention have been herein described, but those skilled in the art will appreciate that various additions, alternatives or modifications to that described may be employed without departing from the principles of the present invention.

Accordingly, what is claimed is:

1. A bullet resistant wearer protective vest for protecting law enforcement officers in the line of duty comprising:

a shell including an upper vest portion;

bullet resistant wearer protective panels of impact absorbing anti-ballistic material secured in fixed positions on the upper vest portion of the shell so as to form a non-stretchable enclosure to at least partially protectively surround the upper torso of a wearer when the vest is worn;

the upper vest portion having a front and a back, and a waist level extending around the front and the back thereof at the approximate height of a wearer's waist when the vest is worn;

the shell further including a horizontally and vertically elastic lower garment portion having an elastic waistband adapted to surround the waist of the wearer and an elastic crotch section adapted to extend between the legs of the wearer, the waistband and crotch section each having a front and a back connected, respectively, to the front and back of the vest portion at the waist level thereof, whereby the lower garment portion connects the back and front of the vest portion together in a first path around the waist of the wearer and in a second path between the legs of the wearer and elastically holds the back and the front of the vest portion both vertically and horizontally at the waist level; and the shell having at least two fasteners at the lower garment portion to enable disconnection between the front and back of the upper vest portion along both of the paths, to thereby facilitate putting on and removal of the vest by the wearer.

2. The vest of claim 1 wherein:

the waistband is permanently connected at the back thereof to the back of the vest portion at the waist level thereof; and the crotch section is permanently connected at the back thereof to the back of the vest portion at the waist level thereof.

3. The vest of claim 2 wherein the fasteners include:

a first fastener in the waistband for disconnecting the front and back parts of the vest portion along the first path; and a second fastener in the crotch section for disconnecting the front and back parts of the vest portion along the second path.

4. The vest of claim 3 wherein:

the second fastener is approximately at the front of the crotch section proximate the front of the waistband.

5. The vest of claim 4 wherein:

the first fastener includes a right and a left first fastener, each on an opposite side of the waistband.

6. The vest of claim 5 wherein:

the first fastener connects the waistband to the crotch section and centers the crotch section approximately at the front of the waistband adjacent the waist of the wearer; and the second fastener connects the front of the waistband and the front of the crotch section to the front of the vest portion at the waist level thereof.

7. The vest of claim 6 wherein:

the waistband is formed permanently continuous in shape;

the crotch section is permanently connected at the front and back thereof to the front and back of the waistband; and the fasteners include a first fastener at the front of the waistband detachably connectable to the front of the vest portion at the waist level thereof and a second fastener at the back of the waistband detachably connectable to the back of the vest portion at the waist level thereof.

8. A shell for a bullet resistant wearer protective vest for protecting law enforcement officers in the line of duty comprising:

an upper vest portion having means for securing bullet resistant wearer protective panels of impact absorbing anti-ballistic material in fixed positions thereon so as to form a non-stretchable enclosure to at least partially protectively surround the upper torso of a wearer when the vest is worn;

the upper vest portion having a front and a back, and a waist level extending around the front and the back thereof at the approximate height of a wearer's waist when the vest is worn;

a horizontally and vertically elastic lower garment portion having an elastic waistband adapted to surround the waist of the wearer and an elastic crotch section adapted to extend between the legs of the wearer, the waistband and crotch section each having a front and a back connected, respectively, to the front and back of the vest portion at the waist level thereof, the lower garment portion connecting the back and front of the vest portion together in a first path around the waist of the wearer and in a second path between the legs of the wearer and elastically holding the back and the front of the vest portion both vertically and horizontally at the back and front of the waist level;

at least two fasteners at the lower garment portion to enable disconnection between the front and back of the upper vest portion along both of the paths, to thereby facilitate putting on and removal of the vest by the wearer.

9. The shell of claim 8 wherein:

the waistband is permanently connected at the back thereof to the back of the upper vest portion at the waist level thereof; and the crotch section is permanently connected at the back thereof to the back of the upper vest portion at the waist level thereof.

10. The shell of claim 9 wherein the fasteners include:

a first fastener in the waistband for disconnecting the front and back parts of the upper vest portion along the first path; and a second fastener in the crotch section for disconnecting the front and back parts of the upper vest portion along the second path.

11. The shell of claim 10 wherein:

the second fastener is approximately at the front of the crotch section proximate the front of the waistband.

12. The shell of claim 11 wherein:

the first fastener includes a right and a left first fastener, each on an opposite side of the waistband.

13. The shell of claim 12 wherein:

the first fastener connects the waistband to the crotch section and centers the crotch section approximately at the front of the waistband adjacent the waist of the wearer; and the second fastener connects the front of the waistband and the front of the crotch section to the front of the upper vest portion at the waist level thereof.

14. The shell of claim 13 wherein:

the waistband is formed permanently continuous in shape;

the crotch section is permanently connected at the front and back thereof to the front and back of the waistband; and the fasteners include a first fastener at the front of the waistband detachably connectable to the front of the upper vest portion at the waist level thereof and a second fastener at the back of the waistband detachably connectable to the back of the upper vest portion at the waist level thereof.

* * * * *

UNITED STATES PATENT AND TRADEMARK OFFICE

CERTIFICATE OF CORRECTION

PATENT NO. : 5,398,340
DATED : March 21, 1995
INVENTOR(S) : Rick E. Kibbee it is certified that error appears in the above-indentified patent and that said Letters Patent is hereby corrected as shown below:

Col. 4, line 39, "Figs. 4-40" should be -- Figs. 4-4C --.

Col. 7, line 2, "Figs. 4-40" should be -- Figs. 4-4C --.

Col. 9, line 63, "claim 4" should be -- claim 3 --.

Col. 9, line 66, "claim 5" should be -- claim 3 --.

Col. 10, line 6, "claim 6" should be -- claim 1 --.

Col. 10, line 68, "claim 11" should be -- claim 10 --.

Col. 11, line 3, "claim 12" should be -- claim 10 --.

Col. 11, line 12, "claim 13" should be -- claim 8 --.

Signed and Sealed this

Fifth Day of September, 1995

*Attest:*

Bruce Lehman

BRUCE LEHMAN

*Attesting Officer*

*Commissioner of Patents and Trademarks*